US005773386A

United States Patent [19]

Langan

[11] Patent Number: 5,773,386

[45] Date of Patent: Jun. 30, 1998

[54] DURABLE IMAGE DIRECT THERMAL LABEL

[75] Inventor: Joseph W. Langan, Cheektowaga, N.Y.

[73] Assignee: Moore U.S.A. Inc., Grand Island, N.Y.

[21] Appl. No.: 806,939

[22] Filed: Feb. 26, 1997

[51] Int. Cl.[6] ..... B41M 5/40

[52] U.S. Cl. ..... 503/226; 427/152; 503/200

[58] Field of Search ..... 427/150–152; 503/200, 226

[56] References Cited

U.S. PATENT DOCUMENTS

| | | | |
|---|---|---|---|
| 4,577,204 | 3/1986 | Shibata et al. | 503/200 |
| 4,633,276 | 12/1986 | Shibata et al. | 503/200 |
| 4,851,383 | 7/1989 | Doi | 503/227 |
| 4,898,849 | 2/1990 | Kang | 503/214 |
| 4,999,334 | 3/1991 | Mehta et al. | 503/226 |
| 5,219,821 | 6/1993 | Arbee et al. | 503/226 |
| 5,278,127 | 1/1994 | Dombrowski et al. | 503/207 |
| 5,292,713 | 3/1994 | Stenzel et al. | 503/226 |
| 5,416,058 | 5/1995 | Uyttendaele et al. | 503/202 |
| 5,508,247 | 4/1996 | Tran et al. | 503/200 |

*Primary Examiner*—Bruce H. Hess
*Attorney, Agent, or Firm*—Nixon & Vanderhye P.C.

[57] ABSTRACT

A thermal sensitive label, and method of manufacture, provide a label construction which is resistant to abrasion without requiring additional coatings. A substantially transparent synthetic material substrate (typically about 1–3 mils thick, but no more than 5 mils thick) has a thermally sensitive coating applied to a first face so that when heat is applied to the second face an image will form on the thermally sensitive material and it will be readable from the second face without significant distortion. A pressure sensitive adhesive, which is preferably pigmented, is disposed on the thermally sensitive material, and may be covered with a release liner. Alternatively, an adhesive release material may be applied on the second face of the substrate.

12 Claims, 2 Drawing Sheets

FIG. 1
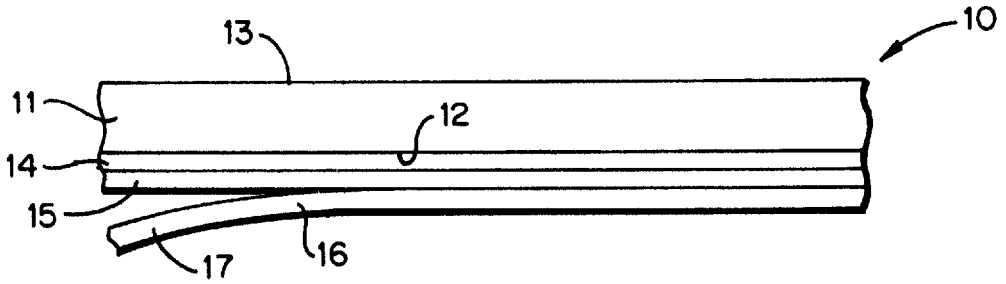
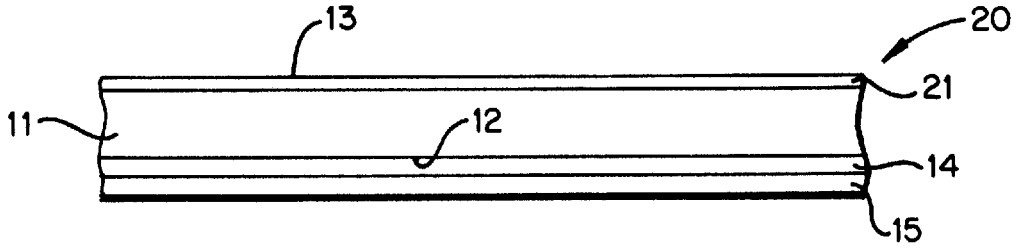
FIG. 2
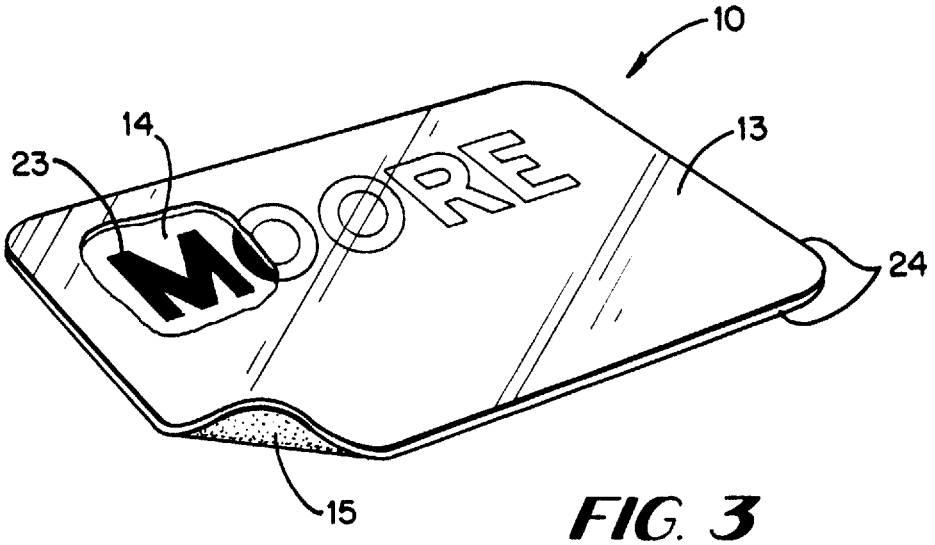
FIG. 3

DURABLE IMAGE DIRECT THERMAL LABEL

BACKGROUND AND SUMMARY OF THE INVENTION

Direct thermal labels usually have a thermally sensitive material coated on the exterior of face thereof. This allows ready access to the coating by a thermal printhead, but leaves the construction vulnerable to abrasion. When the label comes in contact with packages other than that to which it is applied, during handling and shipping, or when transported on conveyor systems, abrasion can destroy or make unreadable images formed on the thermally sensitive coating since such coatings typically have poor abrasion resistance. This problem has been approached in the past by applying some sort of protective coating over the thermal coating such as in U.S. Pat. Nos. 4,851,383, 4,898,849, 5,219,821, and 5,508,247. For example in U.S. Pat. No. 5,219,821 a protective layer in the form of a water soluble cross-linked resin with or without a chitinous material is provided over a thermal coating on a substrate. While such a coating may provide adequate protection, it requires an additional manufacturing step and the protective coating itself may have problems with abrasion in excessive wear situations.

According to the present invention a direct thermal label, and method of manufacture, are provided in which a high degree of abrasion resistance is provided and without requiring a special protective coating. The invention achieves these desired results by utilizing a transparent substrate material and providing the thermal coating on the non-exposed face of the substrate.

According to one aspect of the present invention a thermal sensitive label is provided comprising the following components: A substantially transparent synthetic material substrate having first and second faces. A thermally sensitive material disposed in association with the first face so that when heat is applied to the second face an image will form on the thermally sensitive material and the image will be readable from the second face without significant distortion. And, a pressure sensitive adhesive disposed in association with the thermally sensitive material.

A release liner may be disposed in releasable contact with the pressure sensitive adhesive, or a transparent adhesive release coating may be provided on the substrate second face. The substrate typically has a thickness of at least one mil, and less than five mils, preferably being approximately 1–3 mils thick. Typically the thermally sensitive material is coated directly on a substrate first face and the pressure sensitive adhesive is coated directly on the thermal sensitive material. The pressure sensitive adhesive preferably is pigmented and the thermally sensitive material is substantially transparent. In a preferred embodiment the label may consist of the substrate, thermally sensitive material, adhesive, and either a release liner or release coating.

According to another aspect of the present invention a method of making a durable image direct thermal label from a web of substantially transparent synthetic substrate material less than five mils thick, and having first and second faces, is provided. The method comprises the steps of: (a) Coating the first face with thermally sensitive imaging material. (b) Applying a coating of pressure sensitive material to the thermally sensitive material. And, (c) bringing the pressure sensitive material into contact with an adhesive release material. Steps (a) through (c) may be practiced sequentially. Step (c) may be practiced by providing an adhesive release coating on the second face of the substrate, and rolling the web into a roll so that the adhesive comes into contact with the release coating. Alternatively step (c) may be practiced by bringing a release liner into contact with the adhesive (in fact a piece of transfer tape may be brought into contact with the thermally sensitive material providing both the adhesive and the release liner at once). Step (a) may be practiced by applying a transparent thermally sensitive material directly on the substrate first face, without a tie coat, and step (b) may be practiced by applying a pigmented adhesive directly to the thermally sensitive material. Steps (a) through (c) are typically practiced using a substrate approximately 1–3 mils thick.

The method may also comprise the further step (d) of applying a thermal print element into operative contact with the second face of the substrate so that an image forms on the thermally sensitive material, which image is visible from the second face of the substrate without significant distortion. The method may consist of steps (a) through (c) or (a) through (d).

It is the primary object of the present invention to provide a durable direct thermal label, that is one having high abrasion resistance, yet being constructed in a simple manner. This and other objects of the invention will become clear from an inspection of the detailed description of the invention and from the appended claims.

BRIEF DESCRIPTION OF THE DRAWINGS

FIG. 1 is a side view, with the components greatly exaggerated in size for clarity of illustration, of an exemplary thermal sensitive label according to the present invention;

FIG. 2 is a view like that of FIG. 1 only of a second embodiment;

FIG. 3 is a top perspective view of the label of FIG. 1 with one corner turned up and with the release liner removed.

DETAILED DESCRIPTION OF THE DRAWINGS

Figure 4:
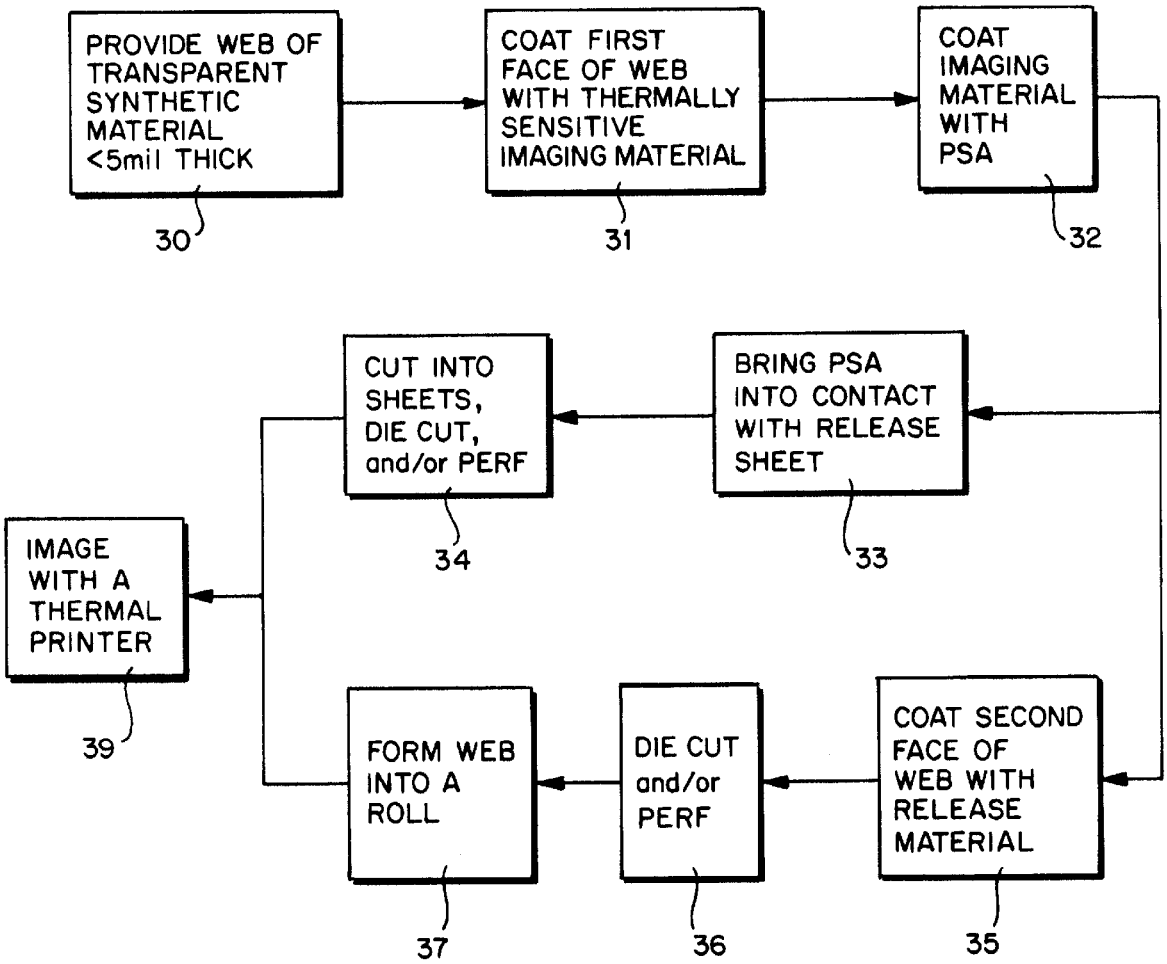
FIG. 4 is a flow sheet schematically illustrating an exemplary method according to the present invention.

A durable image direct thermal label according to the present invention is shown generally by reference numeral 10 in FIG. 1. The label 10 includes a substantially transparent synthetic material substrate 11 having first and second faces 12, 13, respectively. The substrate 11 preferably is at least about one mil thick and preferably less than five mils thick. With most synthetic materials, such as the plastics typically used for label construction, if the substrate is more than five mils thick there may be distortion of the image viewed through the substrate, and/or it may be more difficult to crisply form the image utilizing conventional thermal printers.

Associated with the first face 12 of the label 10 is a thermally sensitive material 14. It is associated with the face 12 so that when heat supplied to the second face 13, using a conventional thermal printer, an image will form on the thermally sensitive material 14 and the image will be readable from a second face 13 without significant distortion. While under some circumstances and with some materials 14 it may be necessary to apply a transparent tie coat, preferably the material 14 is coated directly onto the face 12, as illustrated in FIG. 1.

While a wide variety of conventional materials may be utilized for the substrate 11 and the coating 14, preferably the substrate 11 with the thermally sensitive material 14 already applied thereto is utilized as a purchased off-the-shelf item, such as thermal films from Labelon sold under the trade names F97-021-2 and F96-218A.

The label 10 also includes a pressure sensitive adhesive 15 disposed in association with the thermally sensitive material 14. While, again, a tie coat may be utilized, preferably the pressure sensitive adhesive 15 is applied directly to the material 14, as illustrated in FIG. 1. The pressure sensitive adhesive 15 preferably is pigmented, such as with titanium dioxide or other inorganic material, and it may be directly or transfer coated to the layer 14. While a wide variety of conventional pressure sensitive adhesives (either permanent, removable, or repositional, but preferably permanent) may be provided, one particular example is National Starch 4144 pigmented adhesive.

The label 10 in FIG. 1 also comprises a conventional release liner 16 which covers the adhesive 15. In FIG. 1 the release liner 16—which typically includes a silicone coating at least on the face thereof engaging the adhesive 15—may be readily separated from the adhesive 15 such as by pulling in the direction of arrow 17. The release liner 16 may be separately applied to the adhesive 15 once the adhesive 15 is already in contact with the layer 14, or the release liner 16 and adhesive 15 may be applied together as a piece of transfer tape.

Typically the adhesive 15 covers substantially the entire thermal material layer 14, and/or the face 12 if the material 14 does not cover the entire face 12, although patterns for both the material 14 and the adhesive 15 may be applied, such as strips, blocks, or other conventional patterns.

FIG. 2 illustrates a second embodiment of a label, shown generally by reference numeral 20, according to the present invention. The elements 11 through 15 in this embodiment are the same as in the FIG. 1 embodiment. The difference in the construction of the label 20 is that instead of a release liner 16 a conventional adhesive release material coating 21 (such as a silicone coating) is applied to the second face 13 either using a tie coat, or preferably directly onto the face 13. The release coat 21 may be one of those shown in U.S. Pat. No. 5,292,713, the disclosure of which is hereby incorporated by reference herein.

FIG. 3 shows the label 10 of FIG. 1 in perspective view, with the release liner 16 removed and after an image 23 has been formed on the layer 14. The image 23 is formed by bringing a thermal printhead, or a like device, of conventional construction into contact with the face 13. Because the substrate 11 is not too thick thermal transfer readily takes place and a sharp image 23 is formed, and the image 23 is readily viewed through the substrate 11 without distortion. The label 10 has edges 24 which are formed by die cuts, perforations, or edges of the web material from which the label 10 is constructed. When the label 10 is applied with the adhesive 15 in contact with a surface, such as the surface of a package, shelf, wrapping, or the like, the material 14 is very effectively protected from abrasion by the substrate 11 itself, so that there is only an extremely small chance that the image 23 could be destroyed or occluded by abrasion unless the entire label 10 was destroyed.

FIG. 4 illustrates an exemplary method of making a durable image direct thermal label 10, 20, from a web of substantially transparent synthetic substrate material (e.g. plastic) less than five mils thick and having first and second faces (12, 13), the web forming the substrate 11 of the label 10, 20 so produced. The provision of the transparent web is illustrated schematically by box 30 in FIG. 4. Typically—as indicated by box 31—the first face 12 is coated with the thermally sensitive imaging material 14, preferably directly, but under some circumstances using a conventional tie coat. Then—as illustrated by box 32—the imaging material 14 is coated with a pressure sensitive adhesive 15, again preferably directly but possibly using a tie coat.

One alternative method after the practice of step 32 is—as illustrated by box 33—to bring the pressure sensitive adhesive 15 into contact with a release liner 16. Alternatively steps 32, 33 could be practiced together by bringing the adhesive from a piece of conventional transfer tape into contact with the material 14. After step 33 the web is cut into sheets, die cut, and/or perforated to form individual labels 10, or sheets of labels 10 from which the individual labels 10—as illustrated in FIG. 3—may be readily separated.

As an alternative to steps 33, 34, as indicated by box 35, the second face 13 of the web may be coated with adhesive release material 21. Then the web is die cut and/or perfed as illustrated schematically at 36 in FIG. 4, to form the labels 20. Then the web—or a significant length of the web—is formed into a roll as indicated at 37 in FIG. 4, bringing the adhesive 15 from one part of the web into contact with the adhesive release material 21 from another part of the web and the roll.

Using either the labels 10, 20 produced ultimately either from steps 34 or 37, respectively, the image 23 is formed—as indicated schematically at box 39 in FIG. 4—by bringing a thermal printer, or the like, into contact with the face 13 (or the coating 21 on the face 13).

It will thus be seen that according to the present invention a durable image direct thermal sensitive label, and a simple, straight-forward, and effective manner of production thereof, have been provided. Labels according to the invention should have unmatched durability of the images formed on the thermally sensitive material thereof, and have a minimum of component parts.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and procedures.

What is claimed is:

1. A thermal sensitive label, comprising:

a substantially transparent synthetic material substrate having first and second faces;

a thermally sensitive material disposed in association with said first face so that when heat is applied to said second face an image will form on said thermally sensitive material and said image will be readable from said second face without significant distortion; and a pressure sensitive adhesive disposed in association with said thermally sensitive material.

2. A label as recited in claim 1 further comprising a release liner disposed in releasable contact with said pressure sensitive adhesive.

3. A label as recited in claim 1 further comprising a transparent adhesive release coating provided on said substrate second face.

4. A label as recited in claim 1 wherein said substrate is less than 5 mils thick.

5. A label as recited in claim 4 further comprising a transparent silicone adhesive release coating provided directly on said substrate second face.

6. A label as recited in claim 1 wherein said thermally sensitive material is coated directly on said substrate first face.

7. A label as recited in claim 6 wherein said pressure sensitive adhesive is coated directly on said thermally sensitive material.

8. A label as recited in claim 7 wherein said pressure sensitive adhesive is pigmented, and said thermally sensitive material is substantially transparent.

9. A label as recited in claim 8 wherein said substrate is approximately 1–3 mils thick.

10. A label as recited in claim 9 further comprising a release liner disposed in releasable contact with said pressure sensitive adhesive, said label consisting only of said substrate, thermally sensitive material, adhesive, and release liner.

11. A label as recited in claim 9 further comprising a transparent adhesive release coating provided on said substrate second face, said label consisting only of said substrate thermally sensitive material, adhesive, and release coat.

12. A label as recited in claim 1 where in said substrate is approximately 1–3 mils thick.

* * * * *